US007619518B2

(12) United States Patent
Subotic et al.

(10) Patent No.: US 7,619,518 B2
(45) Date of Patent: Nov. 17, 2009

(54) INTRUSION DETECTION METHODS AND APPARATUS THAT USE A BUILDING'S INFRASTRUCTURE AS PART OF A SENSOR

(75) Inventors: Nikolas Subotic, Ann Arbor, MI (US); Christopher Roussi, Kalamazoo, MI (US); Peter Jensen, Ann Arbor, MI (US); William Buller, Dexter, MI (US)

(73) Assignee: Michigan Technological University, Houghton, MI (US)

( * ) Notice: Subject to any disclaimer, the term of this patent is extended or adjusted under 35 U.S.C. 154(b) by 224 days.

(21) Appl. No.: 11/565,790

(22) Filed: Dec. 1, 2006

(65) Prior Publication Data

US 2008/0018462 A1 Jan. 24, 2008

Related U.S. Application Data

(60) Provisional application No. 60/741,247, filed on Dec. 1, 2005.

(51) Int. Cl.
*G08B 13/18* (2006.01)
*G08B 13/00* (2006.01)

(52) U.S. Cl. ..... 340/567; 340/541; 340/565; 340/552

(58) Field of Classification Search ..... 340/541, 340/567, 565, 551–552, 561–563, 553–554; 43/59; 109/21, 31, 38; 116/75–99; 200/61.93
See application file for complete search history.

(56) References Cited

U.S. PATENT DOCUMENTS

| | | | | |
|---|---|---|---|---|
| 3,653,023 | A * | 3/1972 | Hall, Jr. | 340/517 |
| 4,155,078 | A * | 5/1979 | Bowling et al. | 340/561 |
| 6,967,584 | B2 * | 11/2005 | Maki | 340/657 |
| 2003/0016129 | A1 * | 1/2003 | Menard et al. | 340/531 |
| 2006/0152404 | A1 * | 7/2006 | Fullerton et al. | 342/28 |
| 2007/0194878 | A1 * | 8/2007 | Touge et al. | 340/5.2 |

* cited by examiner

*Primary Examiner*—Benjamin C Lee
*Assistant Examiner*—Michael Shannon
(74) *Attorney, Agent, or Firm*—Gifford, Krass, Sprinkle, Anderson & Citkowski, P.C.

(57) ABSTRACT

Intrusion detection methods and apparatus exploit the infrastructure of the building itself. The preferred embodiments use the existing power line infrastructure to provide power, data, and sensor observables to a monitoring system which is simply connected at one point, namely, the connection of the building to the city power grid. Computer network interfaces may also be used. In terms of sensors, impedance, capacitive, inductive, electric field and Radar modalities may be used.

7 Claims, 2 Drawing Sheets

$$\frac{dF}{dC} = \frac{-79580}{\sqrt{L_1 \Delta C_g^{-3}}}$$

INTRUSION DETECTION METHODS AND APPARATUS THAT USE A BUILDING'S INFRASTRUCTURE AS PART OF A SENSOR

REFERENCE TO RELATED APPLICATION

This application claims priority from U.S. Provisional Patent Application Ser. No. 60/741,247, filed Dec. 1, 2005, the entire content of which is incorporated herein by reference.

FIELD OF THE INVENTION

This invention relates generally to intrusion detection and, in particular, to methods and apparatus that use a building's infrastructure as part of a sensor.

BACKGROUND OF THE INVENTION

A significant logistical and manpower drain on urban combat units is the maintenance of building security once initially secured. Urban battlefields are truly porous, three dimensional environments whereby enemy combatants can infiltrate secured areas via roofs or tunnels among other hidden ingress/egress points. Enemy combatants in a defensive posture have had time to prepare the battlefield for just such action and also have intimate knowledge of the infrastructure of the cityscape on their side.

The experience of the Russians in Chechnya is a classic case in point. Chechen soldiers routinely circumvented the front lines of the operation via tunnels, etc. to appear in the rear of the Russian lines to inflict very heavy casualties. Due to this threat, units leave soldiers behind to guard buildings to maintain security. Consequently, as a fighting force advances, its capabilities are consistently sapped.

Simple, single-point electronic measures that can detect intrusions would significantly mitigate the personnel burden on urban operations units. The ideal would be to have a single system capable of monitoring an entire extended region (e.g. a neighborhood). However, even a single system capable of monitoring a single building is a significant step up. A serious logistical issue when considering such systems is how much infrastructure must be brought along to 'instrument' the building. If too rigorous, the equipment/logistics burden can be almost as damaging to the fighting capability as the rear guard requirement.

SUMMARY OF THE INVENTION

This invention minimizes structural instrumentation for intrusion detection and other purposes by exploiting the infrastructure of the building itself. The preferred embodiments use the existing power line infrastructure to provide power, data, and sensor observables to a monitoring system which is simply connected at one point, namely, the connection of the building to the city power grid. Computer network interfaces may also be used. In terms of sensors, impedance, capacitive, inductive, electric field and Radar modalities may be used.

DETAILED DESCRIPTION OF THE INVENTION

Figure 1:
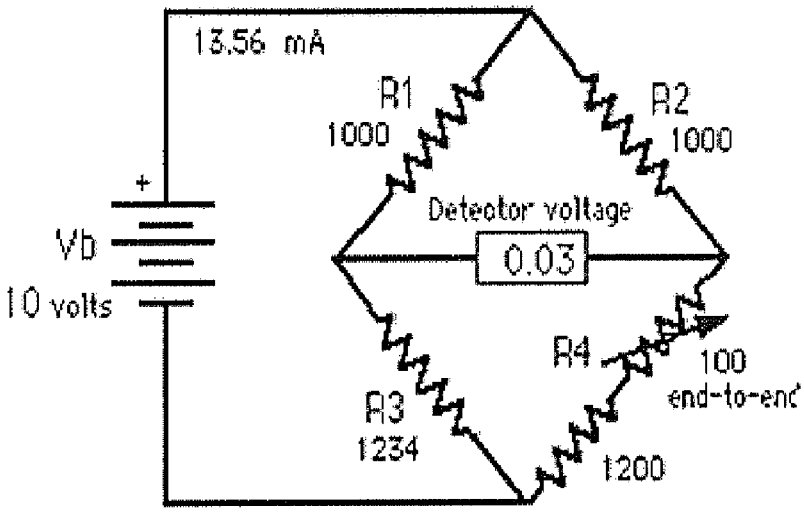
FIGURE 1 (PRIOR ART)
FIG. 1 shows a Wheatstone bridge.

Electrical power has become as prevalent as water in most societies. In cities, practically every building has power. To deliver that power into the building and specifically into rooms of a building, electrical power lines are run though walls, floors, ceilings. Such an infrastructure is ubiquitous.

Recently, it has been realized that this copper infrastructure can be used for much more than just distributing AC power. These power lines can also become wired communications lines with quite high bandwidths. Many commercial products have been created such that a wired intra-net between computers in the home can be created.

Existing systems are capable of ETHERNET type speeds (>14 Mbps), which translate into link bandwidths of >4 MHz (assumed SNR of 10 dB). This motivates concepts whereby data, probing waveforms from active sensors, and even using the power lines as part of the sensor system itself to come to the fore.

Sensor Modalities

There are a number of sensor modalities that can be used to perform intrusion detection from power lines according to the invention. Perhaps the most effective way to achieve sensitivity and robustness is to use change detection. If the building is presumed empty, significant changes due to the presence and/or motion of a body may be cause for alarm.

Table I shows the various sensor modalities being considered with a short description of how they work and pros and cons of the various approaches. The first three approaches are variations on a basic theme; measure a change in the Electromagnetic field due to a presence of a body which changes the characteristic impedance of the space. These approaches can measure changes in capacitance, change in inductance or resistance. The various implementations will be described in the following section either are DC, low frequency AC or RF. The ultrasonic modality is included because these sensors are readily available, can plug into wall sockets, and can provide specificity to where the intrusion occurs. In this case, the power line infrastructure provides the communication link between the various sensors.

TABLE I

| Modality | Concept | Pros | Cons |
|---|---|---|---|
| Capacitive sensing | Electrodes generate an electric field. Objects with a dielectric value affect the capacitance between the electrodes | Detection of metallic or non-metallic objects. Can distinguish mass Can compensate for: dirt build-up, change in temperature or humidity. | Cannot distinguish between different objects which present the same relative permitivity |
| Inductive | Current is induced in a coil wound round a ferrite when a ferrous or non-ferrous metallic target passes through the electro-magnetic field in front of the sensor | Ignores non metallic objects e.g: dirt, water lubricating oil. | Ignores non metallic objects |

TABLE I-continued

| Modality | Concept | Pros | Cons |
|---|---|---|---|
| Electric Field | Electrodes generate an electric field to detect disturbance in the field caused by objects. Passive examples measure or detect existent electric fields. | Using combination of capacitive and electric field sensing it is possible to infer the chemical composition of materials. | Range |
| Radar | Detection and Ranging for long range target detection, measures the strength and round-trip time of microwave signals emitted by an antenna and reflected off a distant surface or object. | Ability to determine speed and direction using doppler shift analysis on received data. | Sophisticated system |

Impedance Sensors: Wheatstone Bridge

The first sensor under consideration is a classic system that is used to measure unknown impedances of objects: The Wheatstone bridge. This type of system is shown in FIG. 1. The system operates at DC. The bridge is balanced using four known impedances configured in a diamond. The balancing is done by adjusting the impedances such that the potential across the detector is zero. When an unknown change in the bridge occurs due to a change in $\Delta R$, a non-zero potential appears across the detector.

In our configuration, the bridge is connected to the power lines of the structure. The application of the DC voltage will induce an electrostatic potential in the various rooms. The ambient impedance of the wires and rooms will be nulled by the bridge. When an intruder appears, the characteristic impedance that the power lines see will change very slightly, on the order of 1 part in $10^4$. Wheatstone bridges have been easily configured to be sensitive to one part in $10^6$. An issue for this type of technology is how much power will be needed to overcome the coupling losses in the lines and the sockets such that the impedance change will be detectable.

Impedance Measurements: Theremin

Another instrument, invented by Leon Theremin in 1918, can be used to measure impedance change. It was originally used to combat tuning problems in regenerative radio circuits. It has a very distinctive, recognizable sound.

Figure 2:
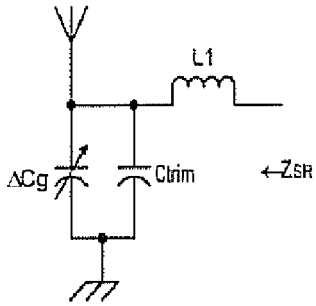
FIGURE 2 (PRIOR ART)
FIG. 2 shows a simple RLC tank circuit.

The Theremin system measures capacitive changes. This is accomplished with an RLC tank circuit, one configuration shown in FIG. 2, whose characteristics change with varying capacitance. The tank circuit is attached to a probe which is a simple wire. If a human is in the proximity of the probe, the circuit capacitance will change.

Figure 3:
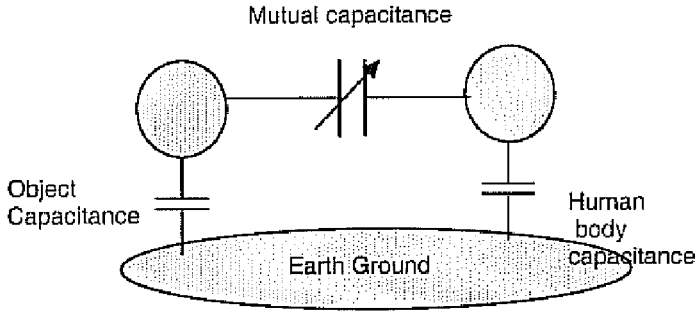
FIGURE 3 (PRIOR ART)
FIG. 3 shows a Theremin measuring the mutual and body capacitance of a person in the proximity of the probe.

FIG. 3 shows the interaction. the tank circuit has an object capacitance. The human body has an inherent capacitance. In addition, the body's proximity to the probe (i.e., the power line(s)) also induces a mutual capacitance. This total capacitance is then measured. Measurements show that a hand at 1m can cause a capacitance change of 1 pF.

Figure 4:
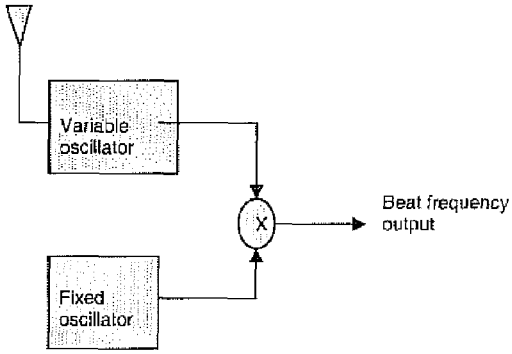
FIGURE 4 (PRIOR ART)
FIG. 4 shows how capacitance controls a variable oscillator which is heterodyned, creating a beat frequency.

According to the invention, the RLC tank is attached to a variable oscillator, which is then mixed with a fixed frequency local oscillator as shown in FIG. 4 In musical applications, the tank circuit is attached to a wire and the movement of a hand changes the capacitance causing the changes in the variable oscillator frequency. After mixing a beat frequency is produced. In a musical instrument application, the beat frequency is in the audio band producing the sound. Depending on the design of the Theremin, a 1 pF capacitance change can cause deflection changes of 4-5 kHz.

In a building monitoring application, the variable oscillator is attached to the power line structure. The power line acts as the probe. The system is aligned such that the impedance of the empty building and infrastructure produces zero frequency offset. When someone comes into a room the capacitance will change which will cause a frequency deflection. This deflection can be detected with a simple Fourier transform channelizer. In addition to the presence of an object causing a frequency deflection, the rate of change of the frequency deflection can be monitored such that the rate of motion of the body can be determined. This is because the mutual capacitance is related to the distance from the person to the probe. The major issues with this system as with the Wheatstone bridge is coupling efficiency. However, musicians have 'played' Theremins from distances of a few meters in concerts with very poor alignment. These systems have proven to be quite robust and sensitive.

RADAR: Time-Domain Reflectometer with MTI Processing

An alternative to systems that measure impedance is the use of a time-delay RADAR reflectometer system employing pulse/pulse subtraction. Note that the copper wire infrastructure can accommodate a 10 MHz bandwidth. This will allow for pulses to be generated and propagate down the wire, couple out into the room and then the reflectometer would monitor the reflection response.

Time-delay reflectometers are commercially available. They are used to find faults in electrical cables among other things. However, there may be a high clutter environment due to imperfections in the cabling, reflections in the room, mutual interference from facing outlets, etc. Consequently, such systems may be modified to perform pulse/pulse subtraction, thus eliminating the steady state response of the building and its infrastructure.

Figure 5A:
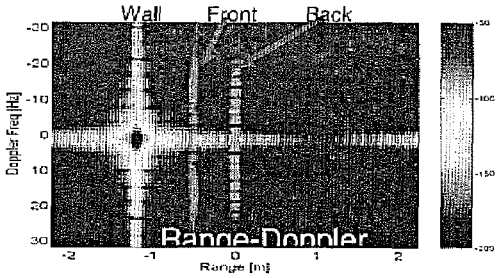
FIG. 5A shows a range Doppler map without pulse-to-pulse subtraction.
Figure 5B:
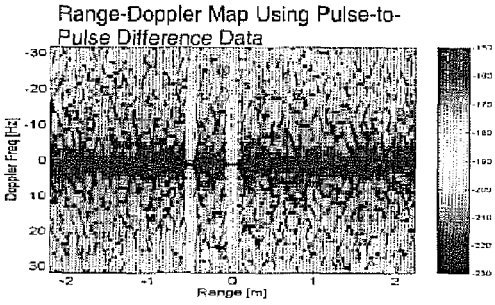
FIG. 5B shows the range Doppler map with pulse-to-pulse subtraction.

An example of the power of pulse/pulse subtraction, FIGS. 5A and 5B show the technique in action for a sniper application. These are simulated range Doppler maps of a sniper behind a wall/window opening. The signature is that of the wall and the gun muzzle. FIG. 5A shows the range Doppler map without pulse-to-pulse subtraction. The huge return of the wall interferes with the signature of the gun muzzle. The clutter is predominantly from the window and wall where the sniper is deployed. The sniper is sweeping his weapon across his field of view. FIG. 5B shows the range Doppler map with pulse-to-pulse subtraction. Pulse-to-pulse subtraction has reduced the stationary steady state clutter by 40 dB making the sniper signature clearly visible. Similar processing will greatly enhance the sensitivity of this system and configure it as a dynamic change detection device.

We claim:

1. A method of determining whether there are any occupants in a building having an electrical infrastructure with power lines running through the walls, floors and ceilings thereof, the method comprising the steps of:

coupling an electronic monitoring instrument to the electrical infrastructure, enabling the instrument to make direct use of the power lines as a sensor; and monitoring changes in an electrical parameter using the sensor to determine if the building is occupied.

2. The method of claim 1, wherein the electrical parameter is impedance.

3. The method of claim 1, wherein electrical parameter is capacitance.

4. The method of claim 1, wherein the electrical parameter is the echo of an electromagnetic signal.

5. The method of claim 2, wherein the instrument is a Wheatstone bridge.

6. The method of claim 3, wherein the instrument is a Theremin.

7. The method of claim 4, wherein the instrument is a time delay RADAR reflectometer which uses the electrical infrastructure as an antenna.

* * * * *